US011877624B2

(12) United States Patent
Ouchi et al.

(10) Patent No.: US 11,877,624 B2
(45) Date of Patent: Jan. 23, 2024

(54) SHOELACE ARRANGEMENT AND SHOELACE GUIDE FOR SHOE

(71) Applicant: Shimano Inc., Osaka (JP)

(72) Inventors: Kaoru Ouchi, Osaka (JP); Toshiaki Aoki, Osaka (JP); Kadunori Iuchi, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 17/529,484

(22) Filed: Nov. 18, 2021

(65) Prior Publication Data

US 2023/0148712 A1 May 18, 2023

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/20
See application file for complete search history.

(56) References Cited

U.S. PATENT DOCUMENTS 5,325,613 A * 7/1994 Sussmann ..... A43C 11/00 24/712.2
5,463,822 A * 11/1995 Miller ..... A43C 11/165 36/50.1
6,416,074 B1 * 7/2002 Maravetz ..... A43C 11/165 36/119.1
7,661,205 B2 * 2/2010 Johnson ..... A43C 11/16 36/50.1
8,474,157 B2 * 7/2013 Motawi ..... A43B 3/0031 36/50.1
8,904,673 B2 * 12/2014 Johnson ..... A43C 1/00 36/58.6
9,474,330 B2 * 10/2016 Panian ..... A43B 3/34
9,642,413 B2 * 5/2017 Seamarks ..... A43B 5/06
9,655,761 B2 * 5/2017 Joseph ..... A61F 5/028
9,700,101 B2 * 7/2017 Lovett ..... A43C 11/008
9,743,709 B2 8/2017 Hesterberg et al.
9,867,417 B2 * 1/2018 Beers ..... A43B 11/00
10,004,297 B2 6/2018 Lovett
10,244,822 B2 4/2019 Beers et al.
10,413,019 B2 9/2019 Soderberg et al.
10,433,999 B2 10/2019 Hammerslag et al.
11,497,278 B2 * 11/2022 Aoki ..... A43B 5/14
2005/0160627 A1 * 7/2005 Dalgaard ..... A43C 11/165 36/50.5
2016/0157561 A1 * 6/2016 Schum ..... A43B 3/34 242/390
2016/0345680 A1 * 12/2016 Rhulen ..... A43C 3/00
2017/0065029 A1 * 3/2017 Bordin ..... A43C 1/00
(Continued)

*Primary Examiner* — Bao-Thieu L Nguyen
(74) *Attorney, Agent, or Firm* — Global IP Counselors, LLP

(57) ABSTRACT

A shoelace arrangement is provided for a shoe. The shoelace arrangement is basically provided with an upper, a shoelace tightener and a shoelace. The upper includes a first surface and a second surface opposite side of the first surface. The shoelace tightener is disposed to the upper. The shoelace is coupled to the shoelace tightener. The shoelace includes a first shoelace portion entirely extending on the first surface, and a second shoelace portion entirely extending on the second surface. The first shoelace portion and the second shoelace portion cross one another via the first surface and the second surface.

16 Claims, 8 Drawing Sheets

(56) References Cited

U.S. PATENT DOCUMENTS

| | | | | |
|---|---|---|---|---|
| 2017/0105489 | A1* | 4/2017 | Lovett | A43C 11/20 |
| 2017/0280817 | A1 | 10/2017 | Hutchinson et al. | |
| 2017/0354207 | A1* | 12/2017 | Signori | A43B 5/14 |
| 2019/0021447 | A1* | 1/2019 | Whewell | A43C 11/004 |
| 2020/0214395 | A1 | 7/2020 | Schneider et al. | |
| 2020/0390196 | A1* | 12/2020 | Manzato | A43C 11/14 |
| 2022/0031024 | A1* | 2/2022 | Cook | A43C 11/008 |

* cited by examiner

SHOELACE ARRANGEMENT AND SHOELACE GUIDE FOR SHOE

BACKGROUND

Technical Field

This disclosure generally relates to a shoelace arrangement and a shoelace guide for a shoe.

Background Information

Generally, a shoe has an upper and a sole. The upper is fixed to the sole, and is configured to receive a wearer's foot. Typically, the upper has a first portion, a second portion, and an opening between the first portion and the second portion. In some shoes, a tightener is coupled between the first portion and the second portion for applying a tightening force to the upper for tightening the upper to a wearer's foot. There are many types of closures that are used for shoes. One example of a shoe having a reel based tightener is disclosed in U.S. Pat. No. 10,413,019 B2 (assigned to Boa Technology, Inc.). In a reel based tightener, a lacing cord wound on a reel which is rotated to selectively tighten and loosen the upper to a wearer's foot.

SUMMARY

Generally, the present disclosure is directed to various features of a shoelace arrangement and/or a shoelace guide for a shoe. One object of the present disclosure is to improve the tightening of the upper to a wearer's foot.

In view of the state of the known technology and in accordance with a first aspect of the present disclosure, a shoelace arrangement is provided for a shoe. The shoelace arrangement is basically comprises an upper, a shoelace tightener and a shoelace. The upper includes a first surface and a second surface opposite side of the first surface. The shoelace tightener is disposed to the upper. The shoelace is coupled to the shoelace tightener. The shoelace includes a first shoelace portion entirely extending on the first surface, and a second shoelace portion entirely extending on the second surface. The first shoelace portion and the second shoelace portion cross one another via the first surface and the second surface.

With the shoelace arrangement according to the first aspect, the shoelace can be easily pulled by the shoelace tightener to tighten the upper to a wearer's foot.

In accordance with a second aspect of the present disclosure, the shoelace arrangement according to the first aspect is configured so that the shoelace tightener includes a reel based tightener.

With the shoelace arrangement according to the second aspect, the shoelace tightener can be easily operated to adjust the tightness level using the reel based tightener.

In accordance with a third aspect of the present disclosure, the shoelace arrangement according to the first aspect or the second aspect is configured so that the upper includes a first part having a first end connected to the upper and a second end free from being coupled to the upper.

With the shoelace arrangement according to the third aspect, the upper can be reliably tightened with the shoelace tightener.

In accordance with a fourth aspect of the present disclosure, the shoelace arrangement according to the third aspect is configured so that the first shoelace portion and the second shoelace portion cross one another adjacent to the second end of the first part.

With the shoelace arrangement according to the fourth aspect, the shoelace can be reliably pulled with the shoelace tightener.

In accordance with a fifth aspect of the present disclosure, the shoelace arrangement according to the third aspect or the fourth aspect is configured so that the first part includes an opening extending from the first surface to the second surface, and the shoelace passes through the opening.

With the shoelace arrangement according to the fifth aspect, the first shoelace portion can be easily positioned entirely on the first surface, and the second shoelace portion can be easily positioned entirely on the second surface.

In accordance with a sixth aspect of the present disclosure, the shoelace arrangement according to any one of the first aspect to the fifth aspect is configured so that the first part includes a strap.

With the shoelace arrangement according to the sixth aspect, the upper can be reliably tightened.

In accordance with a seventh aspect of the present disclosure, A shoelace guide is provided for a shoe. The shoelace guide is basically comprises a main body including a first body surface, a second body surface, and a third body surface extending between the first body surface and the second body surface. The main body further includes a first route and a second route. The first route is configured to receive a first shoelace portion of a shoelace. The second route is spaced apart from the first route as view in a first direction perpendicular to the third body surface, and the second route being configured to receive a second shoelace portion of the shoelace. The first route and the second route cross one another as view in a second direction perpendicular to one of the first body surface and the second body surface.

With the shoelace guide according to the seventh aspect, the shoelace can be easily pulled by the shoelace tightener to tighten the upper to a wearer's foot.

In accordance with an eighth aspect of the present disclosure, the shoelace guide according to the seventh aspect is configured so that the main body is made of a resin material.

With the shoelace guide according to the eighth aspect, the shoelace guide can be lightweight and inexpensive to manufacture.

In accordance with a ninth aspect of the present disclosure, the shoelace guide according to the eighth aspect is configured so that the resin material includes at least one of polyamide, polycarbonate, polyurethane, and acrylonitrile butadiene styrene.

With the shoelace guide according to the ninth aspect, the shoelace guide can be made using a variety of resin materials that are suitable for the particular application.

In accordance with a tenth aspect of the present disclosure, the shoelace guide according to any one of the seventh aspect to the ninth aspect is configured so that the first route and the second route passes between the first body surface and the second body surface.

With the shoelace guide according to the tenth aspect, the shoelace is at least partially protected by the shoelace guide.

In accordance with an eleventh aspect of the present disclosure, the shoelace guide according to any one of the seventh aspect to the tenth aspect is configured so that the first route includes a pair of first openings in the main body and a first passageway extending between the first openings;

and the second route includes a pair of second openings in the main body and a second passageway extending between the second openings.

With the shoelace guide according to the eleventh aspect, a first shoelace portion of the shoelace can be easily routed in the shoelace guide along the first route and a second shoelace portion of the shoelace can be easily routed in the shoelace guide along the second route.

In accordance with a twelfth aspect of the present disclosure, the shoelace guide according to the eleventh aspect is configured so that the third body surface includes the first openings and the second openings.

With the shoelace guide according to the twelfth aspect, the shoelace guide and the shoelace can be relatively compact.

In accordance with a thirteenth aspect of the present disclosure, the shoelace guide according to any one of the seventh aspect to the twelfth aspect is configured so that the main body is a one-piece member.

With the shoelace guide according to the thirteenth aspect, the shoelace guide can have a relatively simple structure.

Also, other objects, features, aspects and advantages of the disclosed shoelace arrangement and the disclosed shoelace guide will become apparent to those skilled in the art from the following detailed description, which, taken in conjunction with the annexed drawings, discloses preferred embodiments of the shoelace arrangement and the shoelace guide.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the footwear field from this disclosure that the following descriptions of the embodiments are provided for illustration only and not for the purpose of limiting the invention as defined by the appended claims and their equivalents.

Figure 1:
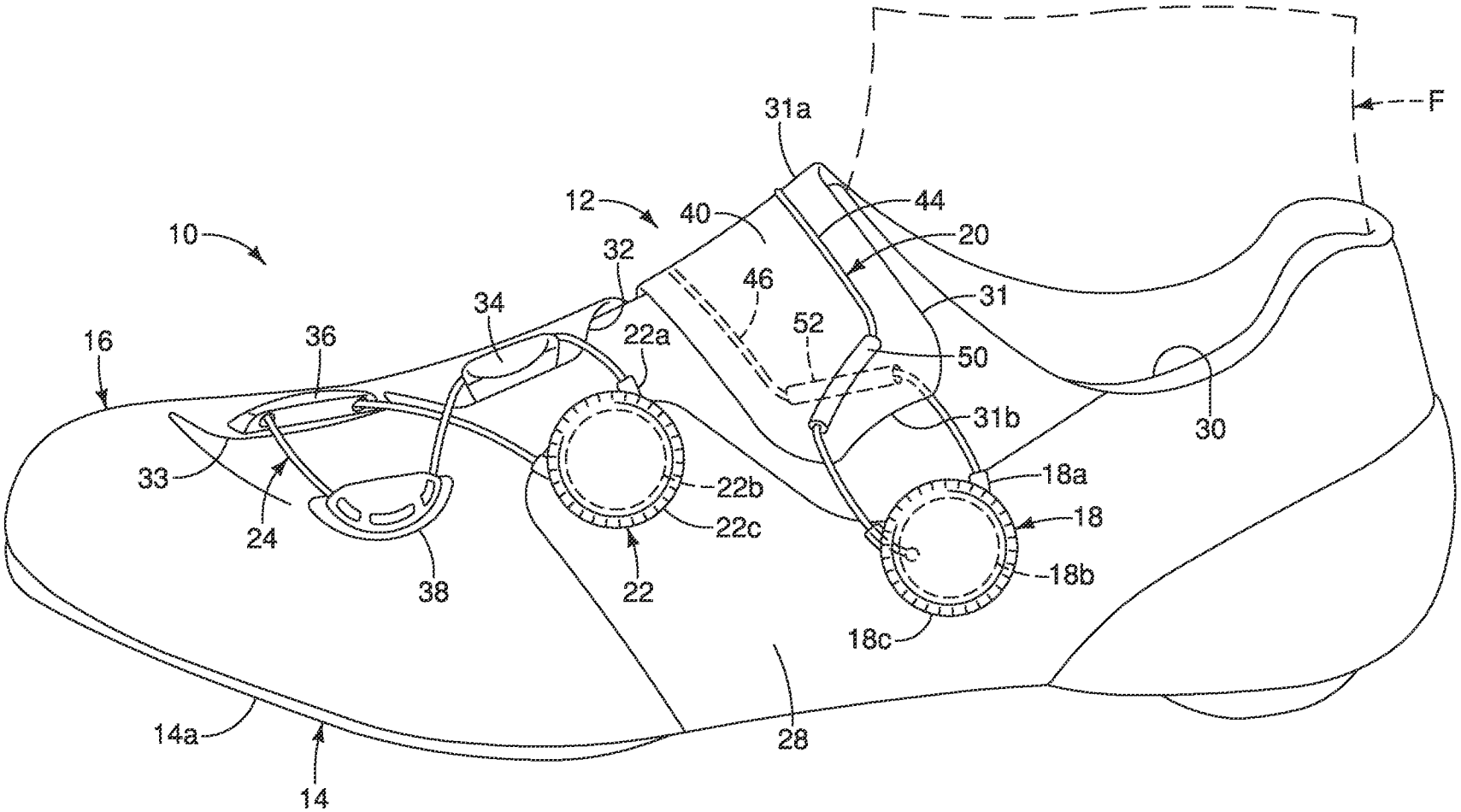
FIG. 1 is an outer side perspective view of a shoe (e.g., cycling shoe) having a shoelace arrangement in accordance with a first embodiment.

Referring initially to FIG. 1, a side perspective view of a shoe 10 having a shoelace arrangement 12 in accordance with a first embodiment. The shoe 10 is configured to be put on a wearer's foot F. The shoe 10 is particularly applicable for cycling. Thus, the shoe 10 constitutes a cycling shoe. However, the shoelace arrangement 12 can be applied to footwear such as shoes for sport use, sneakers, or slippers with straps. Thus, the shoelace arrangement 12 is provided for a shoe.

Figure 2:
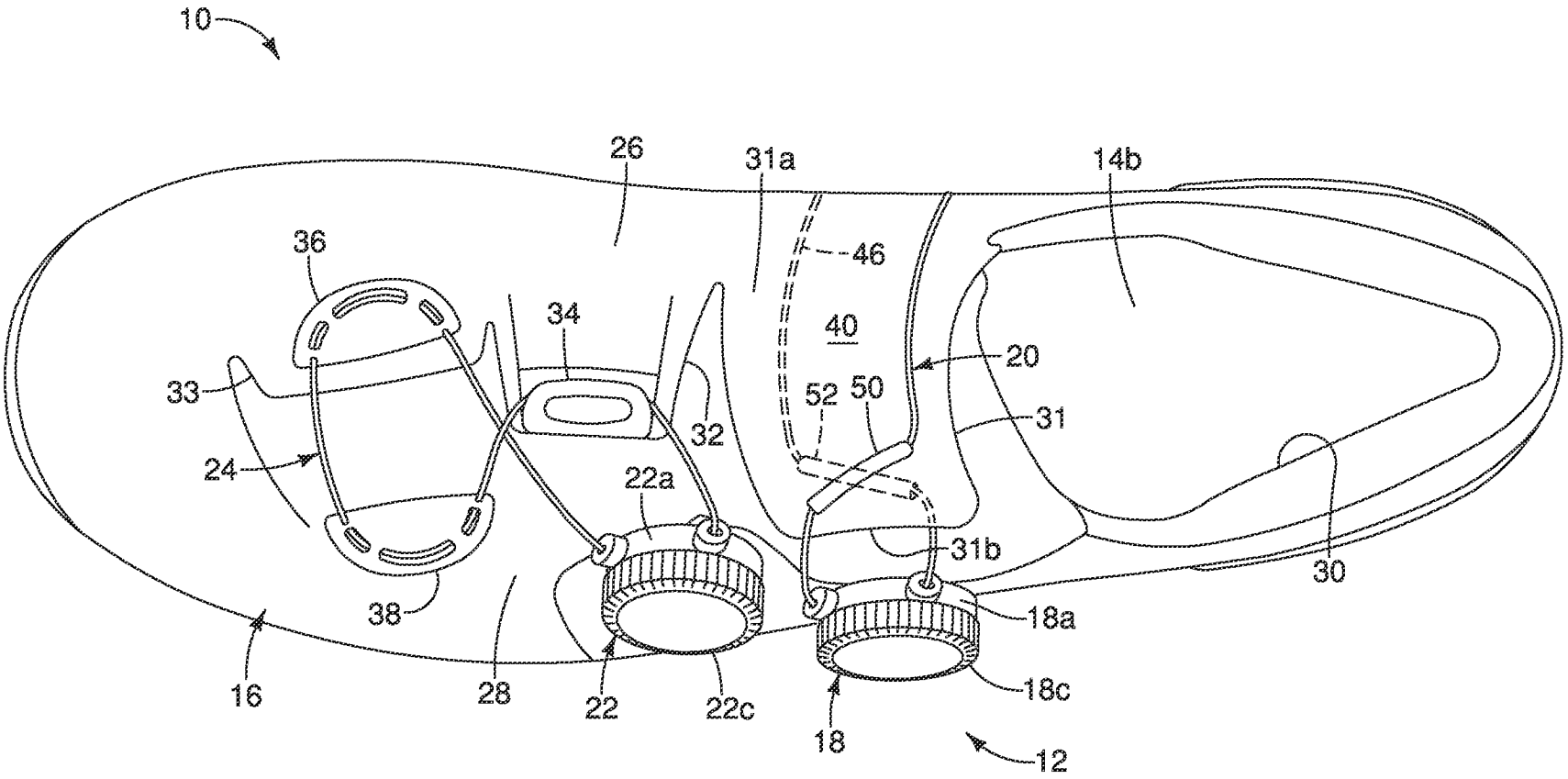
FIG. 2 is a top plan view of the cycling shoe illustrated in FIG. 1.
Figure 3:
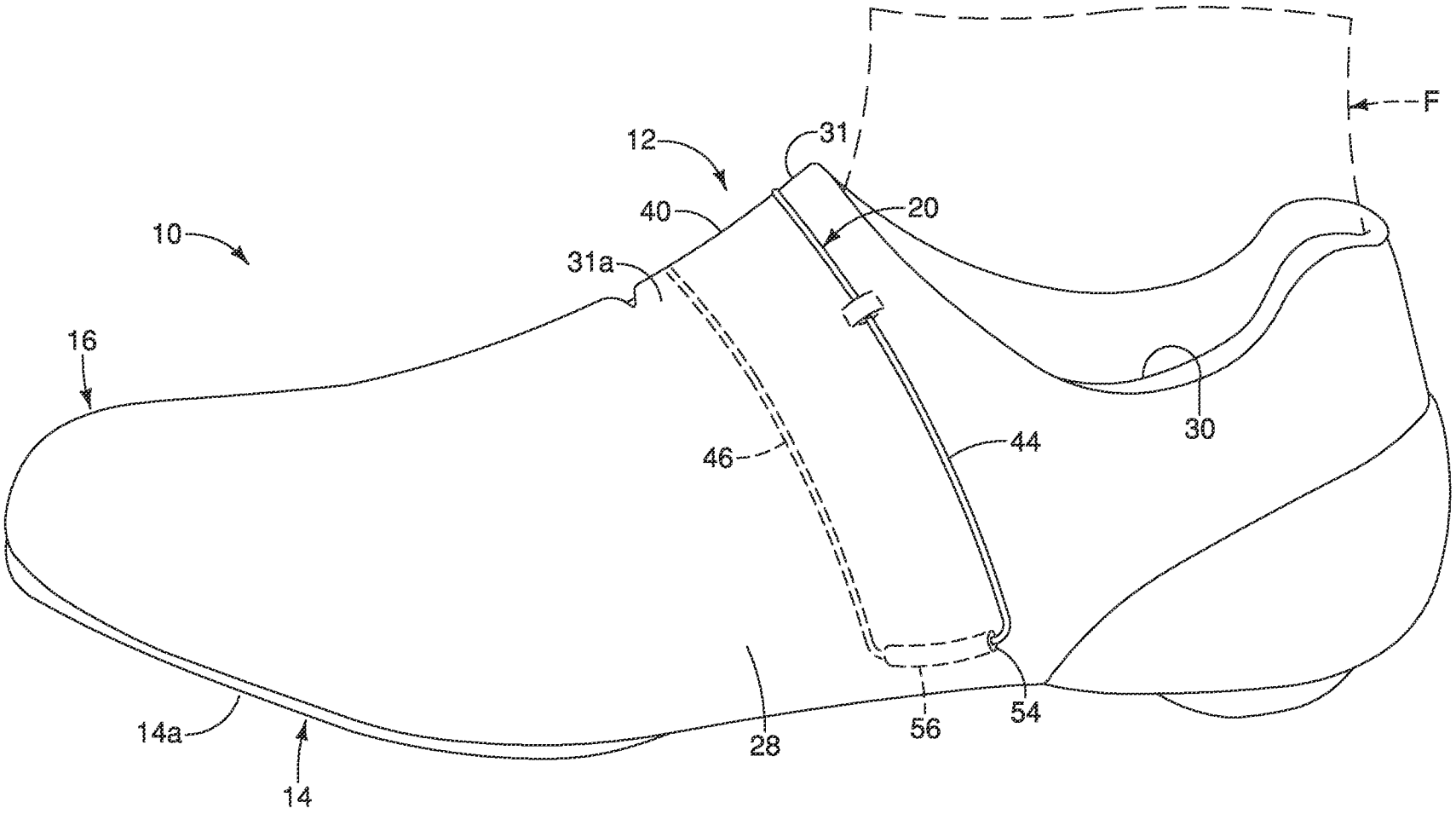
FIG. 3 is an inner side elevational view of the shoe illustrated in FIGS. 1 and 2.
Figure 5:
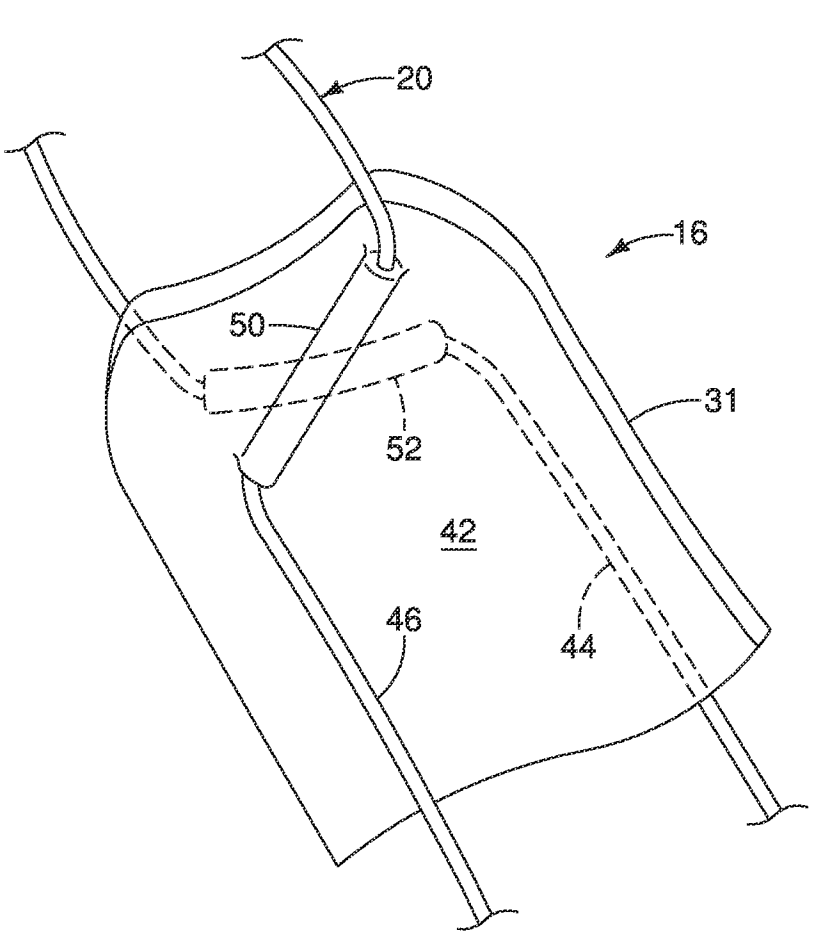
FIG. 5 is a partial bottom side perspective view of the free end portion of the strap illustrated in FIG. 4.
Figure 4:
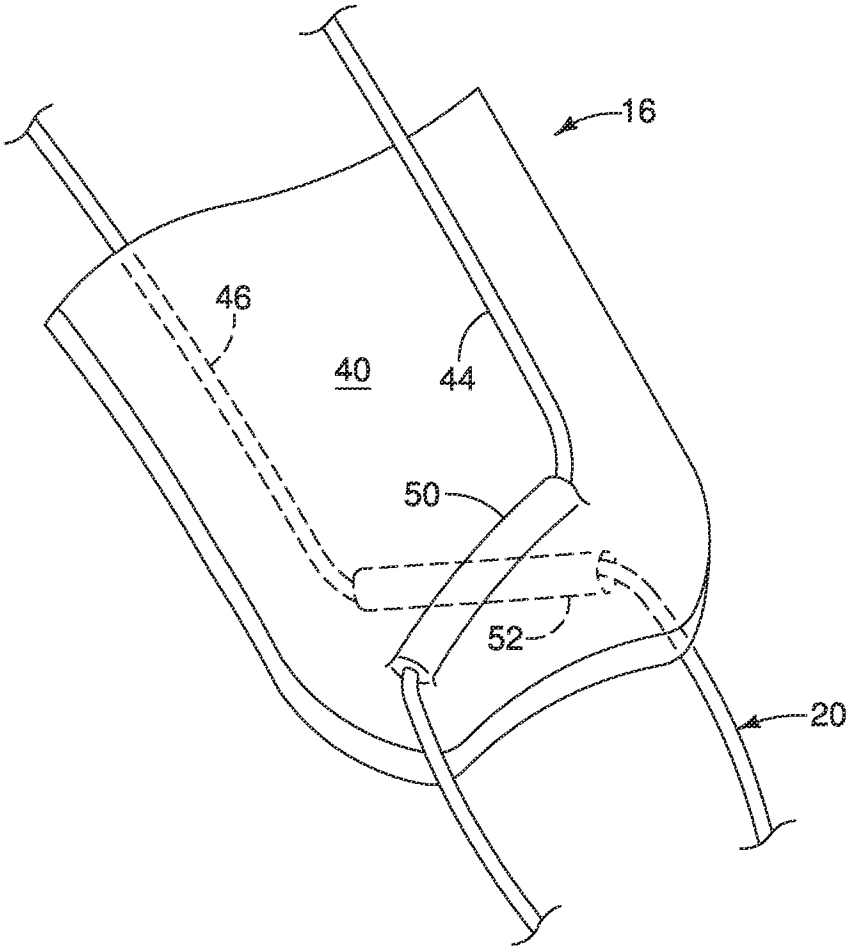
FIG. 4 is a partial top side perspective view of a free end portion of a strap of the shoe illustrated in FIGS. 1 to 3.
Figure 6:
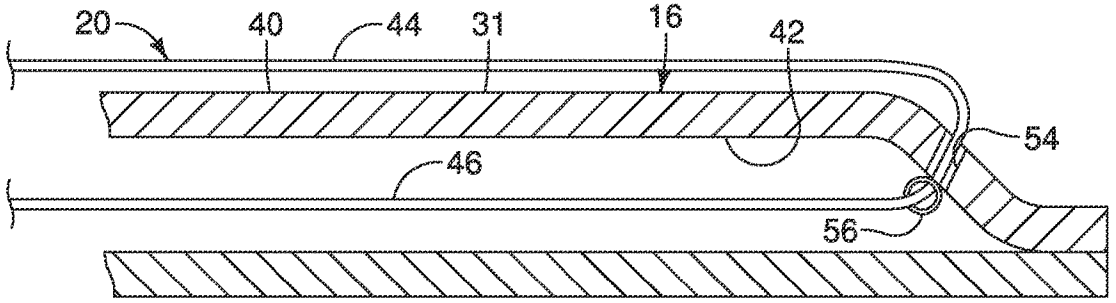
FIG. 6 is a diagrammatic cross sectional view of the upper of the shoe illustrated in FIGS. 1 to 3 showing a first shoelace portion extending on the first surface, and a second shoelace portion extending on the second surface.

As illustrated in FIGS. 1 to 3, the shoe 10 is a left shoe. It should be noted that the present specification explains the shoe 10 to be put on the left foot but omits explanation of a shoe to be put on the right foot. Preferably, a right shoe is a mirror image of the shoe 10. Thus, the shoelace arrangement 12 can be applied to the right shoe. The shoe 10 basically includes a sole 14 and an upper 16.

The sole 14 supports the upper 16. Specifically, the sole 14 is attached to the upper 16. The sole 14 can be fixedly attached to the upper 16 in a conventional manner, such as with stitching, adhesives, and/or embedding portions the upper 16 within the sole 14. Thus, the upper 16 and the sole 14 are integrated together. The sole 14 supports the foot sole. The sole 14 includes an outsole 14*a* and an insole 14*b*. The insole 14*b* is provided on the opposite side of the outsole 14*a*. The outsole 14*a* faces outside the shoe 10. For example, the outsole 14*a* touches the ground. The insole 14*b* faces inside the shoe 10. The insole 14*b* is configured to contact the sole of the wearer's foot F. The sole 14 can also be provided with a midsole between the outsole 14*a* and the insole 14*b*. Optionally, the outsole 14*a* of the sole 14 can be provided with a cleat mounting structure for mounting a bicycle cleat to the bottom of the outsole 14*a*.

The upper 16 covers the top of the wearer's foot F. The upper 16 is attached to the sole 14 as mentioned above. Here, the upper 16 is a low-cut style of upper. However, the upper 16 is not limited to the low-cut style, but may be of any style. The upper 16 is made of any suitable natural or polymetric materials. The upper 16 can be formed of an expandable material or a non-expandable material. For example, the upper 16 can be made of a leather material, a nylon mesh and/or any other material that is utilized for conventional uppers.

In the first embodiment, the shoelace arrangement 12 is basically comprises the upper 16, a shoelace tightener 18 and a shoelace 20. The shoelace tightener 18 is disposed to the upper 16. The shoelace 20 is coupled to the shoelace tightener 18. The shoelace tightener 18 is configured to apply a tightening force to the upper 16 for tightening the upper to the wearer's foot F. Here, the shoelace arrangement 12 further comprises an additional shoelace tightener 22 and an additional shoelace 24. The additional shoelace tightener 22 is also configured to apply a tightening force to the upper 16 for tightening the upper 16 to the wearer's foot F. The shoelace tightener 18 can be considered a first shoelace tightener 18 and a shoelace 20 can be considered an upper shoelace 20. On the other hand, the additional shoelace tightener 22 can be considered a second shoelace tightener 22 and the additional shoelace 24 can be considered a second shoelace 24.

Here, the shoelace tightener 18 includes a reel based tightener. Likewise, the additional shoelace tightener 22 includes a reel based tightener. Reel based tighteners are well known in the footwear industry. For example, a reel based tightener is disclosed in U.S. Pat. No. 10,413,019 B2 (assigned to Boa Technology, Inc.), which can be used for the shoelace tightener 18 and the additional shoelace 24. Of course, it will be apparent that other types of reel based tighteners as well as non-reel based tighteners can be used as needed and/or desired.

Basically, the shoelace tightener 18 includes a base portion 18*a*, a reel portion 18*b* and a knob portion 18*c*. The base portion 18*a* is fixed to the upper 16. The reel portion 18*b* is rotatable mounted to the base portion 18*a*. At least a first end of the shoelace 20 is attached to the reel portion 18*b*. A second end of the shoelace 20 is attached to either the base portion 18*a* or the reel portion 18*b*. The knob portion 18*c* is connected to the reel portion 18*b* to rotate the reel portion 18*b* relative to the base portion 18*a*. A positioning mechanism is provided between to the base portion 18*a* and the reel portion 18*b* to incrementally pull and incrementally release the shoelace 20 from the shoelace tightener 18. The positioning mechanism of the shoelace tightener 18 can be any type of positioning mechanism such as for example the one disclosed in U.S. Pat. No. 10,413,019 B2.

Similarly, the additional shoelace tightener 22 includes a base portion 22*a*, a reel portion 22*b* and a knob portion 22*c*. The base portion 22*a* is fixed to the upper 16. The reel portion 22*b* is rotatable mounted to the base portion 22*a*. At least a first end of the shoelace 20 is attached to the reel portion 22*b*. A second end of the shoelace 20 is attached to either the base portion 22*a* or the reel portion 22*b*. The knob portion 22*c* is connected to the reel portion 22*b* to rotate the reel portion 22*b* relative to the base portion 22*a*. A positioning mechanism is provided between to the base portion 22*a* and the reel portion 22*b* to incrementally pull and incrementally release the additional shoelace 24 from the additional shoelace tightener 22. The positioning mechanism of the additional shoelace tightener 22 can be any type of positioning mechanism such as for example the one disclosed in U.S. Pat. No. 10,413,019 B2.

As seen in FIG. 2, the upper 14 has a first portion 26, a second portion 28, and an opening 30 between the first portion 26 and the second portion 28. The shoelace tightener 18 and the additional shoelace tightener 22 are provided on the second portion 28 of the upper 16. The shoelace tightener 18 and the additional shoelace tightener 22 are configured to pull the first portion 26 towards the second portion 28 for tightening the upper 16 to the wearer's foot F. Here, the upper 16 includes a first part 31 having a first end 31*a* connected to the upper 16 and a second end 31*b* free from being coupled to the upper 16. Preferably, the first part 31 includes a strap 31*c*. The first part 31 is coupled to the first portion 26 and partially overlies the second portion 28. The first part 31 is coupled to the shoelace tightener 18 by the shoelace 20. As the reel portion 18*b* of the shoelace tightener 18 by is rotated, the shoelace 20 is pulled to tighten the upper 16 onto the wearer's foot F, or released to loosen the upper 16 around the wearer's foot F.

Also, the upper 16 includes a second part 32 and a third part 33 connected to the first portion 26 of the upper 16. The second part 32 and the third part 33 are coupled to the first portion 26, and partially overlie the second portion 28. The second part 32 has a shoelace guide 34 and the third part 33 has a shoelace guide 36. The second portion 28 also has a shoelace guide 38. The additional shoelace 24 has its ends connected to the additional shoelace tightener 22. The additional shoelace 24 is further hooked onto the shoelace guides 34, 36 and 38 such that the additional shoelace 24 is wound on a reel of the additional shoelace tightener 22 to tighten the upper to a wearer's foot and unwound from the loosen the upper to a wearer's foot. As the reel portion 22*b* of the additional shoelace tightener 22 by is rotated, the additional shoelace 24 is pulled to tighten the upper 16 onto the wearer's foot F, or released to loosen the upper 16 around the wearer's foot F.

The upper 16 includes a first surface 40 and a second surface 42 that is an opposite side of the first surface 40. Here, the first surface 40 is an exterior surface of the shoe 10. The second surface 42 includes an interior surface of the shoe 10 as a well as the surfaces of the first part 31, the second part 32 and a third part 33 that overlie portions of the second portion 28 of the upper 16.

The shoelace 20 includes a first shoelace portion 44 and a second shoelace portion 46. The first shoelace portion 44 entirely extends on the first surface 40. The second shoelace portion 46 entirely extends on the second surface 42. Preferably, the second shoelace portion 46 entirely extends on the second surface 42 without contacting the first shoelace portion 44. The first shoelace portion 44 and the second shoelace portion 46 cross one another via the first surface 40 and the second surface 42. Here, a first shoelace guide 50 is provided on the first surface 40, and a second shoelace guide 52 is provided on the second surface 42. The first shoelace guide 50 is configured to guide the first shoelace portion 44 along a section of the first surface 40. The second shoelace guide 52 is configured to guide the second shoelace portion 46 along a section of the second surface 42. The first shoelace guide 50 and the second shoelace guide 52 cross one another via the first surface 40 and the second surface 42. Preferably, the first shoelace guide 50 and the second shoelace guide 52 cross one another adjacent to the second end of the first part. Here, the first shoelace guide 50 and the second shoelace guide 52 are tubes that are made of a material having a low coefficient friction such as a smooth resin material. Preferably, the resin material includes at least one of polyamide, polycarbonate, polyurethane, and acrylonitrile butadiene styrene. Alternatively, the first shoelace guide 50 and the second shoelace guide 52 can be made of a loop provided to the first part 31 of the upper 16.

In the first embodiment, the first part 31 includes an opening 54. The opening 54 extends from the first surface 40 to the second surface 42. The shoelace 20 passes through the opening 54. In this way, the strap 31*c* of the first part 31 separates the first shoelace portion 44 from the second shoelace portion 46. Optionally, a shoelace guide 56 is provided to the inside of the upper 16 for receiving the second shoelace portion 46. Here, the shoelace guide 56 is a tube that is made of a material having a low coefficient friction such as a smooth resin material. Preferably, the resin material includes at least one of polyamide, polycarbonate, polyurethane, and acrylonitrile butadiene styrene. Alternatively, the first shoelace guide 50 and the second shoelace guide 52 can be made of a loop provided to the first part 31 of the upper 16.

Referring now to FIGS. 7 to 11, a shoe 110 (e.g., cycling shoe) having a shoelace arrangement 112 is illustrated in accordance with a second embodiment. The shoe 110 basically includes a sole 114 and an upper 116. Similar to the first embodiment, the shoelace arrangement 112 is basically comprises the upper 116, a shoelace tightener 118 and a shoelace 120. Also, similar to the first embodiment, the shoelace arrangement 112 further comprises an additional shoelace tightener 122 and an additional shoelace 124. In the second embodiment, the shoe 110 is identical to the shoe 10, except that the shoelace arrangement 112 has been modified to include a shoelace guide 125 for the shoe 110. In view of the similarity between the first and second embodiments, the descriptions of the parts of the second embodiment that are identical to the parts of the first embodiment may be omitted for the sake of brevity.

Figure 7:
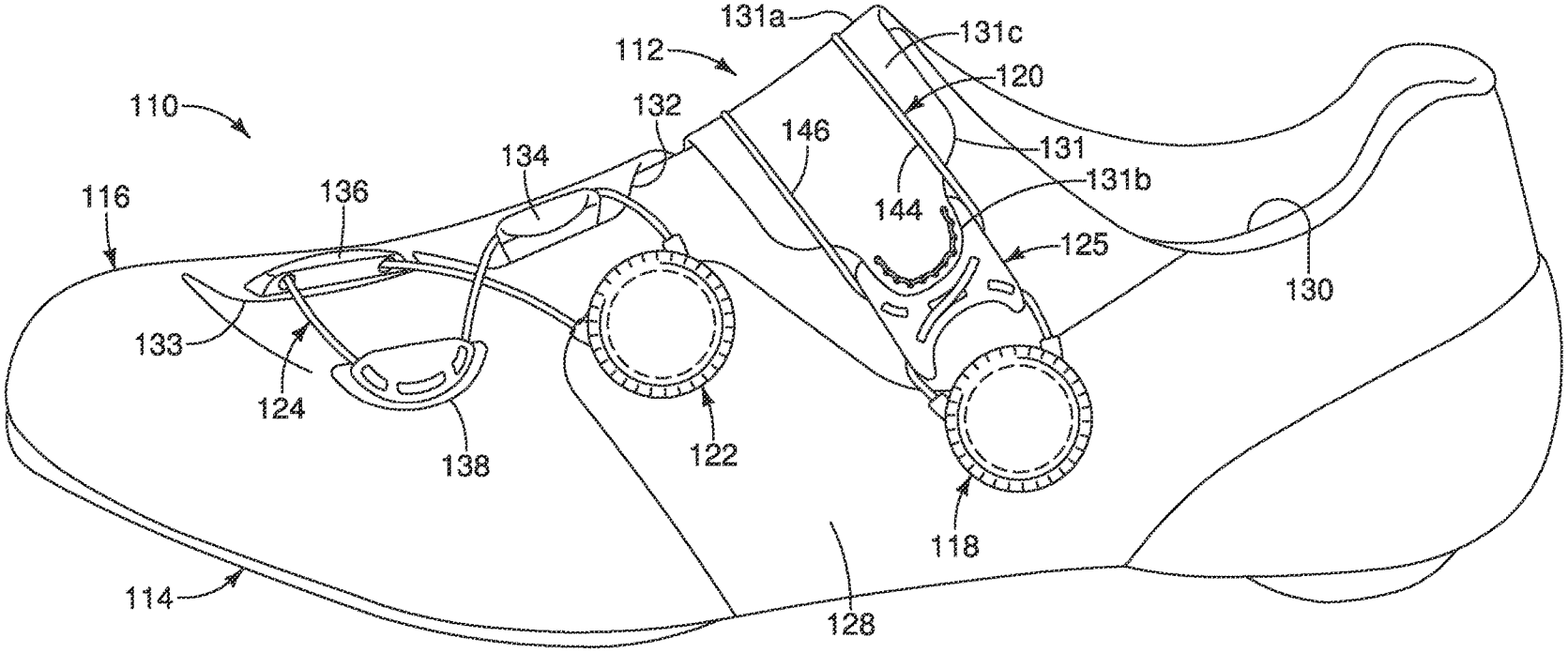
FIG. 7 is an outer side perspective view of a shoe (e.g., cycling shoe) having a shoelace arrangement in accordance with a second embodiment in which the shoelace arrangement includes shoelace guide.
Figure 8:
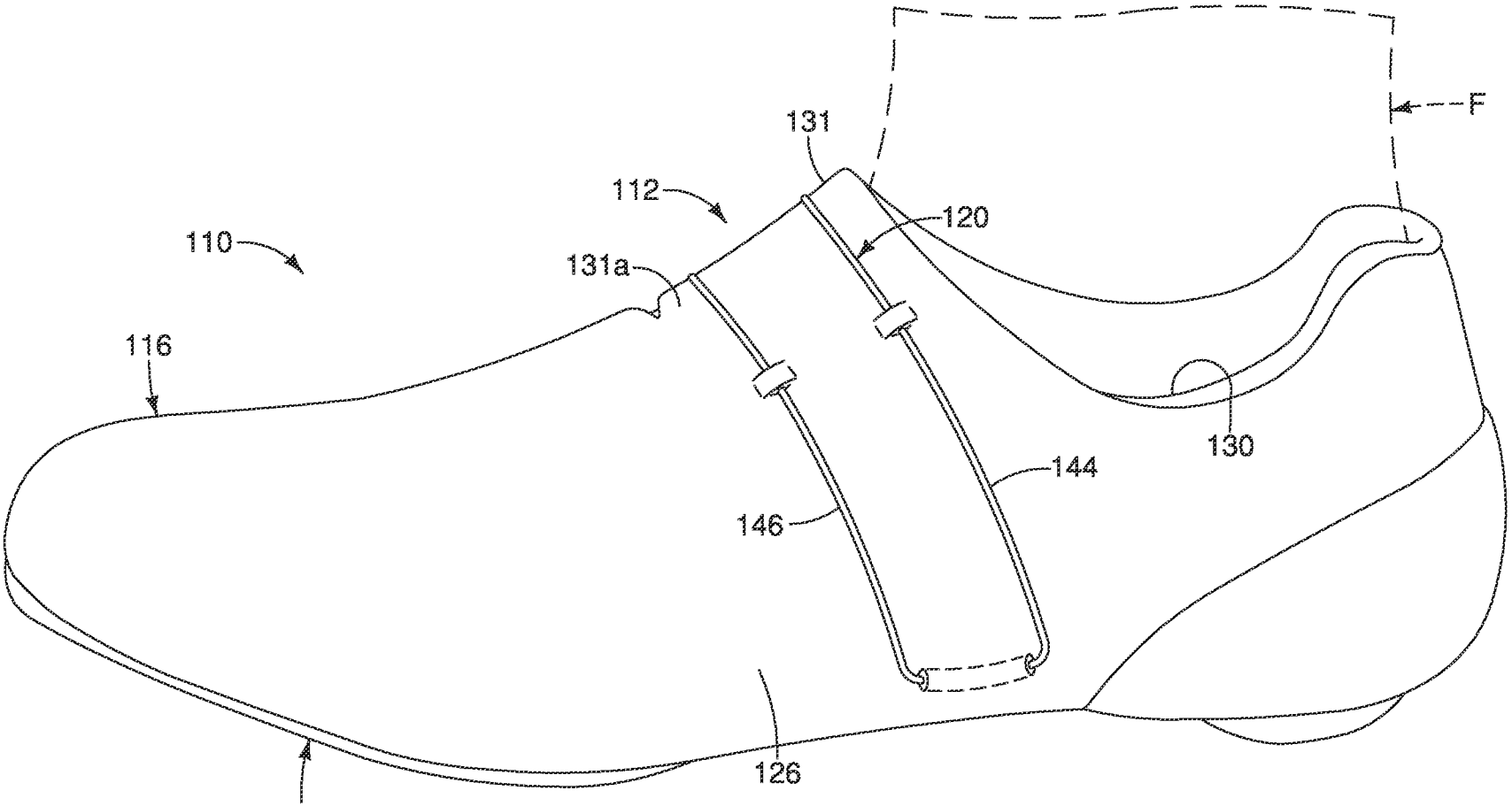
FIG. 8 is an inner side elevational view of the shoe illustrated in FIG. 7.

As seen in FIGS. 7 and 8, the upper 114 has a first portion 126, a second portion 128, and an opening 130 between the first portion 126 and the second portion 128. The shoelace tightener 118 and the additional shoelace tightener 122 are provided on the first portion 126 of the upper 116. In particular, the upper 116 includes a first part 131 having a first end 131*a* connected to the upper 116 and a second end 131*b* free from being coupled to the upper 116. Preferably, the first part 131 includes a strap 131*c*. The first part 131 is coupled to the first portion 126 and partially overlies the second portion 128. The first part 131 is coupled to the shoelace tightener 118 by the shoelace 120. Also, the upper 116 includes a second part 132 and a third part 133 connected to the first portion 126 of the upper 116. The second part 132 and the third part 133 are coupled to the first portion 216, and partially overlie the second portion 128. The second part 132 has a shoelace guide 134 and the third part 133 has a shoelace guide 136. The second portion 128 also has a shoelace guide 138. The additional shoelace 124 has its ends connected to the additional shoelace tightener 122. The additional shoelace 124 is further hooked onto the shoelace guides 134, 136 and 138. Thus, similar to the first embodiment, the shoelace tightener 118 and the additional shoelace tightener 122 are configured to pull the first portion 126 towards the second portion 128 for tightening the upper 116 to the wearer's foot F.

Here, the shoelace guide 125 is attached to the strap 131*c* at the second end 131*b*. The shoelace guide 125 can be considered a part of the upper 116. The shoelace 20 includes a first shoelace portion 144 and a second shoelace portion 146. The shoelace guide 125 is configured to avoid contact between the first shoelace portion 144 and the second shoelace portion 146. In particular, the shoelace guide 125 basically comprises a main body 160. The main body 160 includes a first body surface 162, a second body surface 164, and a third body surface 166 extending between the first body surface 162 and the second body surface 164. The first shoelace portion 144 is primarily disposed on the first body surface 162. The shoelace portion 146 is primarily disposed on the second body surface 164.

Figure 9:
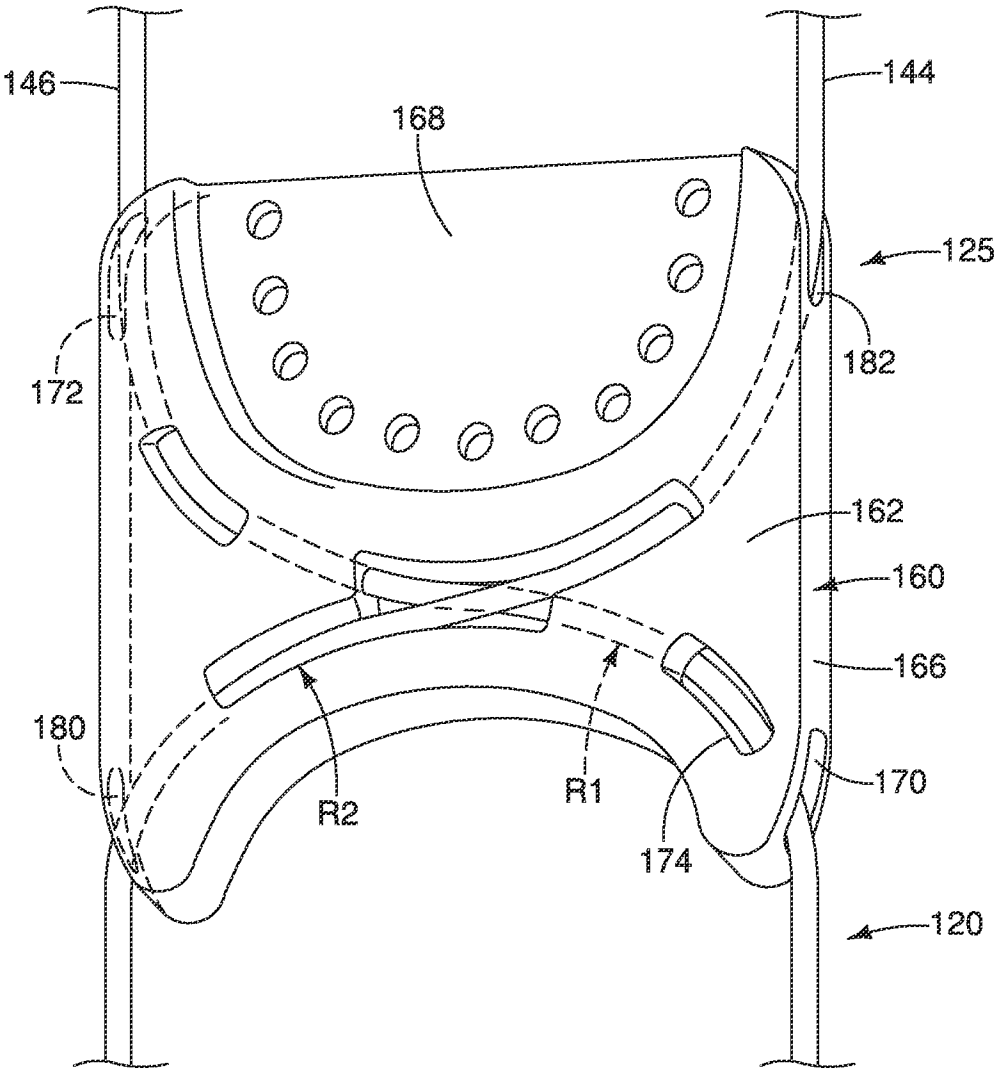
FIG. 9 is an enlarged perspective view of a first side of the shoelace guide illustrated in FIGS. 7 and 8 where the shoelace has been routed through the shoelace guide.
Figure 11:
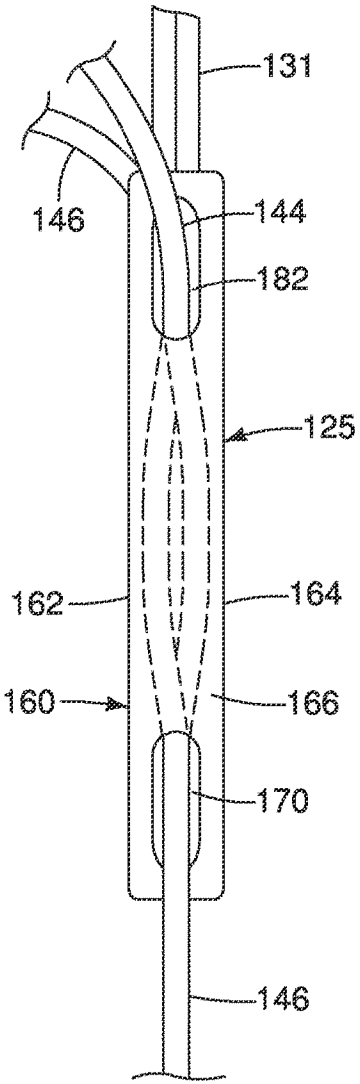
FIG. 11 is a side view of the shoelace guide illustrated in FIGS. 7 to 10 where the shoelace has been routed through the shoelace guide.
Figure 10:
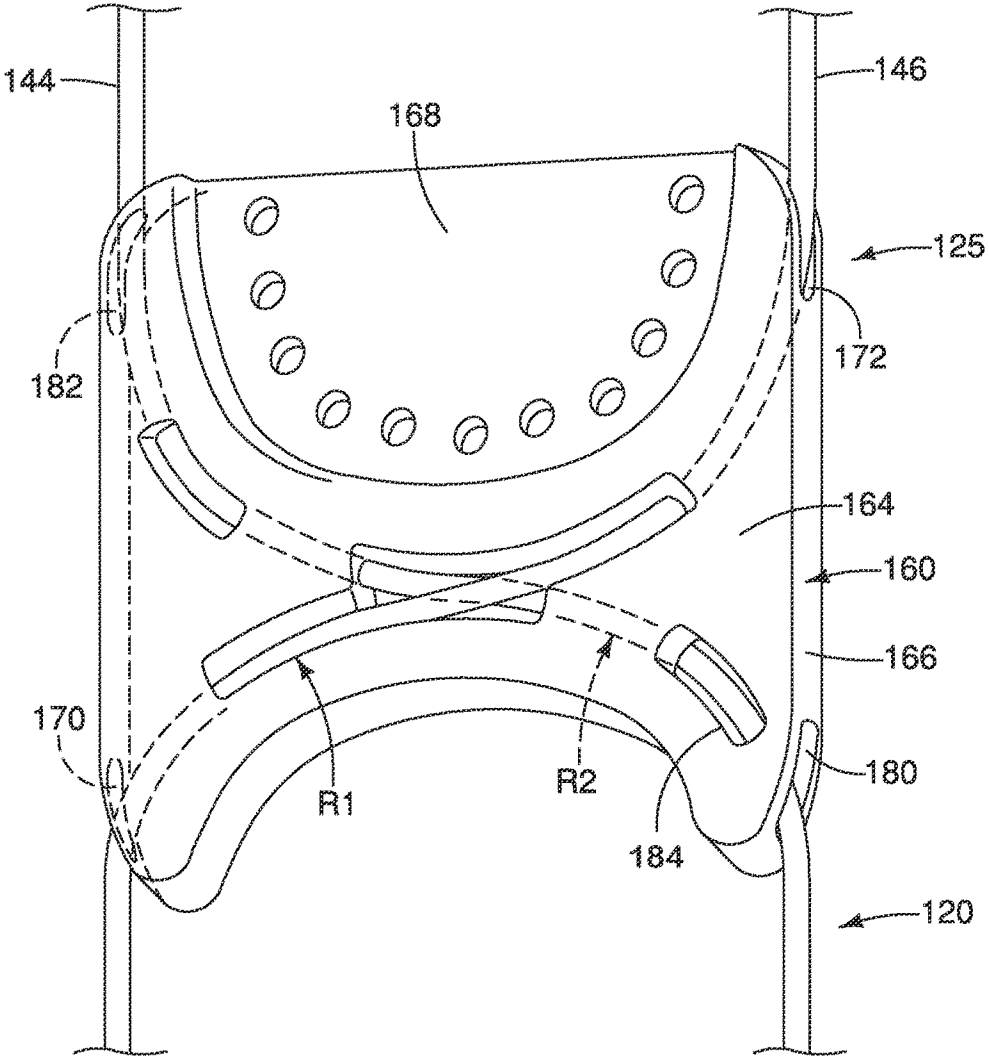
FIG. 10 is an enlarged perspective view of a second side of the shoelace guide illustrated in FIGS. 7 and 8 where the shoelace has been routed through the shoelace guide.

More specifically, as seen in FIGS. 9 and 10, the main body 160 further includes a first route R1 and a second route R2. The first route R1 is configured to receive the first shoelace portion 144 of the shoelace 120. The second route R2 is spaced apart from the first route R1 as view in a first direction D1 that is perpendicular to the third body surface 166. The second route R2 is configured to receive the second shoelace portion 146 of the shoelace 120. The first route R1 and the second route R2 cross one another as view in a second direction D2 that is perpendicular to one of the first body surface 162 and the second body surface 164. Here, the first route R1 and the second route R2 passes between the first body surface 162 and the second body surface 164.

In the second embodiment, the main body 160 is made of a resin material. Preferably, the resin material includes at least one of polyamide, polycarbonate, polyurethane, and acrylonitrile butadiene styrene. Also, preferably, the main body 160 is a one-piece member. However, the main body 160 could be made of two or more piece joined together. Here, the main body 160 has an attachment portion 168 for attaching the strap 131*c*. The strap 131*c* can be made of two layers that are sewn to the attachment portion 168 of the main body 160 of the shoelace guide 125.

Also, the first route R1 includes a pair of first openings 170, 172 in the main body 160 and a first passageway 174 extending between the first openings 170, 172. Here, the first passageway 174 opens partially on the first body surface 162 and the second body surface 164. The second route R2 includes a pair of second openings 180, 182 in the main body 160 and a second passageway 184 extending between the second openings 180, 182. Here, the second passageway 184 opens partially on the first body surface 162 and the second body surface 164. Preferably, the third body surface 166 includes the first openings 170, 172 and the second openings 180, 182.

In accordance with one possible modification of the first embodiment, the first shoelace guide 50 and the second shoelace guide 52 can both be provided on the first surface 40 such that the first shoelace portion 44 and the second shoelace portion 46 cross one another on the first surface 40. Also, in this modification, the first shoelace guide 50 and the second shoelace guide 52 can be combined into a single shoelace guide. In ether case, the first shoelace portion 44 and the second shoelace portion 46 can be guided such that the first shoelace portion 44 and the second shoelace portion 46 do not contact at the cross over point. On the other hand, the shoelace guide can be configured such that the first shoelace portion 44 and the second shoelace portion 46 contact at the cross over point. However, if the first shoelace portion 44 and the second shoelace portion 46 contact at the cross over point, then the tightening forces will increases due to the frictional contact of the first shoelace portion 44 and the second shoelace portion 46 during tightening of the shoelace 20.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

It should be understood from the drawings and the description herein that the directional terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe comprising:

an upper including a first surface and a second surface opposite side of the first surface;

a shoelace tightener disposed to the upper;

a first shoelace guide;

a second shoelace guide; and a shoelace coupled to the shoelace tightener and including a first shoelace portion entirely extending on the first surface through the first shoelace guide, and a second shoelace portion entirely extending on the second surface through the second shoelace guide;

wherein the first and second shoelace guides cross one another via the first surface and the second surface.

2. The shoe according to claim 1, wherein the shoelace tightener includes a reel based tightener.

3. The shoe according to claim 1, wherein the upper includes a first part having a first end connected to the upper and a second end free from being coupled to the upper.

4. The shoe according to claim 3, wherein the first shoelace portion and the second shoelace portion cross one another adjacent to the second end of the first part.

5. The shoe according to claim 3, wherein the first part includes an opening extending from the first surface to the second surface, and the shoelace passes through the opening.

6. The shoe according to claim 1, wherein the first part includes a strap.

7. A shoelace guide for a shoe, the shoelace guide comprising:

a main both including a first body surface, a second both surface, and a third both surface extending between the first body surface and the second body surface, the main body further including a first route configured to receive a first shoelace portion of a shoelace, and a second route being spaced apart from the first route as view in a first direction perpendicular to the third body surface, and the second route being configured to receive a second shoelace portion of the shoelace, wherein the first route and the second route are configured to receive the first shoelace portion and the second shoelace portion, respectively. such that the first shoelace portion and the second shoelace portion cross one another as viewed in a second direction perpendicular to one of the first body surface and the second body surface.

8. The shoelace guide according to claim 7, wherein the main body is made of a resin material.

9. The shoelace guide according to claim 8, wherein the resin material includes at least one of polyamide, polycarbonate, polyurethane, and acrylonitrile butadiene styrene.

10. The shoelace guide according to claim 7, wherein the first route and the second route passes between the first body surface and the second body surface.

11. The shoelace guide according to claim 7, wherein the first route includes a pair of first openings in the main body and a first passageway extending between the first openings;

the second route includes a pair of second openings in the main body and a second passageway extending between the second openings.

12. The shoelace guide according to claim 11, wherein the third body surface includes the first openings and the second openings.

13. The shoelace guide according to claim 7, wherein the main body is a one-piece member.

14. The shoelace guide according to claim 7, wherein the first route and the second route are configured to receive the first shoelace portion and the second shoelace portion, respectively, such that the first shoelace portion and the second shoelace portion cross one another in an X shape as viewed in the second direction.

15. The shoelace guide according to claim 11, wherein the pair of first openings and the pair of second openings are arranged such that a first line segment joining the pair of first openings and a second line segment joining the second openings cross each other in an X shape as viewed in the second direction.

16. The shoelace guide according to claim 11, wherein the first passageway and the second passageway are configured to cross each other at an intermediate portion of the main body.

* * * * *